US005887839A

United States Patent [19]

Smith et al.

[11] Patent Number: 5,887,839

[45] Date of Patent: Mar. 30, 1999

[54] ROTATABLE CLIPBOARD

[76] Inventors: Marvin Ray Smith; Elmora Smith, both of 16419 Pradera Dr., Houston, Tex. 77083

[21] Appl. No.: 881,068

[22] Filed: Jun. 24, 1997

[51] Int. Cl.[6] ..... A47B 97/04

[52] U.S. Cl. ..... 248/452; 248/444; 2/160; 281/45; 312/190

[58] Field of Search ..... 248/444, 452, 248/451, 450, 349.1, 118, 118.1, 118.3, 118.5; 2/160, 161.2; 281/45, 43, 42, 44, 51; 402/4, 80 R

[56] References Cited

U.S. PATENT DOCUMENTS

| | | | |
|---|---|---|---|
| 988,893 | 4/1911 | Packewitz | 248/118.5 |
| 1,317,423 | 9/1919 | Bottle | 108/12 |
| 1,407,239 | 2/1922 | Weiss | 281/51 |
| 1,419,190 | 6/1922 | Zipoy | 281/44 |
| 1,510,877 | 10/1924 | Wiedenmann | 248/118.5 |
| 2,606,774 | 8/1952 | Zalkind | 312/190 |
| 2,701,173 | 2/1955 | Senior et al. | 108/43 |
| 2,876,022 | 3/1959 | Kroviak | 108/43 |
| 4,243,249 | 1/1981 | Goss | 281/1 |
| 4,313,585 | 2/1982 | Bricker | 248/118.5 |
| 4,356,651 | 11/1982 | Barlow | 40/308 |
| 4,824,140 | 4/1989 | Rankin | 281/8 |
| 4,896,927 | 1/1990 | Liu et al. | 312/190 |
| 4,903,932 | 2/1990 | Stewart, Jr. | 248/444 |
| 4,906,025 | 3/1990 | Schrendl | 281/45 |
| 4,968,258 | 11/1990 | Kees | 434/370 |
| 4,988,229 | 1/1991 | Ramsey, III | 402/4 |
| 5,180,133 | 1/1993 | Chang | 248/452 |
| 5,180,191 | 1/1993 | Biba | 281/45 |
| 5,417,456 | 5/1995 | Laubacher | 281/45 |
| 5,421,616 | 6/1995 | Laubacher | 281/45 |
| 5,531,481 | 7/1996 | Wiltshire | 281/44 |
| 5,577,273 | 11/1996 | Newkirt et al. | 2/160 |
| 5,706,521 | 1/1998 | Haney | 2/160 |
| 5,758,902 | 6/1998 | McManus | 281/45 |

*Primary Examiner*—Leslie A. Braun
*Assistant Examiner*—Tan Le
*Attorney, Agent, or Firm*—Kenneth L. Tolar

[57] ABSTRACT

The present invention relates to a rotatable clipboard assembly comprising a substantially rectangular base component having a planar bottom surface and four sides depending therefrom. The area between the four sides and the planar bottom surface defines a paper holding bin. A lid component is attached to a side of the base component using a hinge means allowing the paper holding bin to be selectively enclosed. A glove component is attached to the bottom surface of the clipboard using a rotating bearing assembly allowing a user to insert his or her hand into the glove component and rotate the clipboard to a desired position. Alternatively, an arm component is attached to the bearing assembly allowing the device to be attached to and rotated about a person's arm or wrist.

15 Claims, 2 Drawing Sheets

ROTATABLE CLIPBOARD

BACKGROUND OF THE INVENTION

The present invention relates to a clipboard/portfolio combination having a glove component rotatably attached to an exterior side thereof. The clipboard comprises a substantially rectangular base component designed to receive papers or business forms. The base component has a substantially planar bottom surface and four sides depending upwardly therefrom to define a paper holding bin. A planar lid component having approximately the same dimensions as the planar bottom surface is hingedly attached to a side of the base component allowing the paper holding bin to be selectively enclosed.

The glove component is rotatably mounted to the bottom surface of the base component using a rotatable bearing assembly. This particular embodiment may be suitable for police officers who issue numerous citations and who are constantly rotating their clipboards to allow a ticketed driver to view or write on a document resting thereon. In an alternate embodiment that may be more applicable to warehouse or dock workers, a foldable pivoting arm member may be attached to the rotating bearing assembly allowing the device to be attached to a user's wrist or forearm.

DESCRIPTION OF THE PRIOR ART

Various styles of notebooks and clipboards having straps, handles or other similar carrying means are generally known in the prior art. However, none of these devices disclose a clipboard or notebook having a rotatable or pivoting hand or arm attachment means. U.S. Pat. No. 4,988,229 issued to Ramsey, III relates to a looseleaf notebook designed for retaining bar code listings. The notebook includes an adjustable strap which encircles the binding of the notebook. The strap allows the notebook to be held open and manipulated by a user who slides a hand between the strap and binding so that a bar code reader may be manipulated with the other hand.

U.S. Pat. No. 5,180,191 issued to Biba discloses a folder having a plurality of joined, stacked panels each having aligned apertures therethrough. The aligned apertures form a handle allowing the folder to be easily carried or manipulated.

U.S. Pat. No. 5,417,456 issued to Laubacher discloses a folder holder comprising an elastic band wrapped in an absorbent material which may be removably attached to the spine of a music folder. The device allows a music folder to rest on the palm of the hand as opposed to the fingers.

U.S. Pat. No. 5,421,616 issued to Laubacher also discloses a folder holder comprising a flexible handle removably attached to a music folder or similar device using Velcro®.

SUMMARY OF THE INVENTION

Police officers, mail clerks, warehouse workers and similar personnel typically use clipboards, notepads and binders for writing traffic citations, filling out forms, invoices, bills of lading and other similar business forms. These workers typically have to hold such devices within their fingers resulting in additional stress and strain to the hands. In addition, the devices are often used as a writing surface for themselves and for customers, truck drivers, vehicle drivers who have been ticketed and so forth. Simultaneously holding a clipboard and a document resting thereon while another person views or writes on the a document can be cumbersome and difficult. The user must generally turn the clipboard around while holding the paper with the other or alternatively must hold both items in the same hand.

Therefore, there is currently a need for a clipboard that can easily attach to a user's hand and can rotate thereabout allowing another person to easily view or write on a document resting thereon. The present invention provides a simple and easy to use clipboard that addresses the above described problems. It is therefore an object of the present invention to provide a clipboard that may be easily attached to a user's hand thus reducing the stress and strain that would otherwise be directed to the user's fingers.

It is yet another object of the present invention to provide a clipboard that may be selectively rotated while attached to a person's hand or arm.

It is yet another object of the present invention to provide a clipboard that may be interchangeably connected to a person's hand, wrist or forearm depending upon the application.

It is yet further object of the present invention to provide a clipboard that may be rotated about a person's hand in 90 degree increments using an indexing mechanism.

It is yet another object of the present invention to provide police officers who issue citations with a clipboard that may be easily and interchangeably used as a writing surface by both the officer and the driver being ticketed.

It is yet another object of the present invention to provide a clipboard that can attach to and rotate about a user's hand or wrist while securely holding documents thereon. Other objects, features and advantages of the present invention, its details of construction and arrangement of parts which will be seen from the following description of the preferred embodiment when considered with the attached drawings and appended claims.

DESCRIPTION OF THE PREFERRED EMBODIMENT

Figure 2:
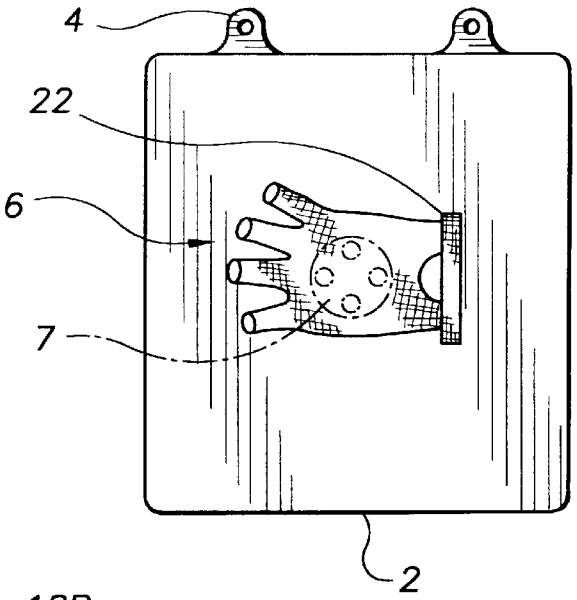
FIG. 2 depicts the bottom surface of the base component with the glove component attached thereto
Figure 3:
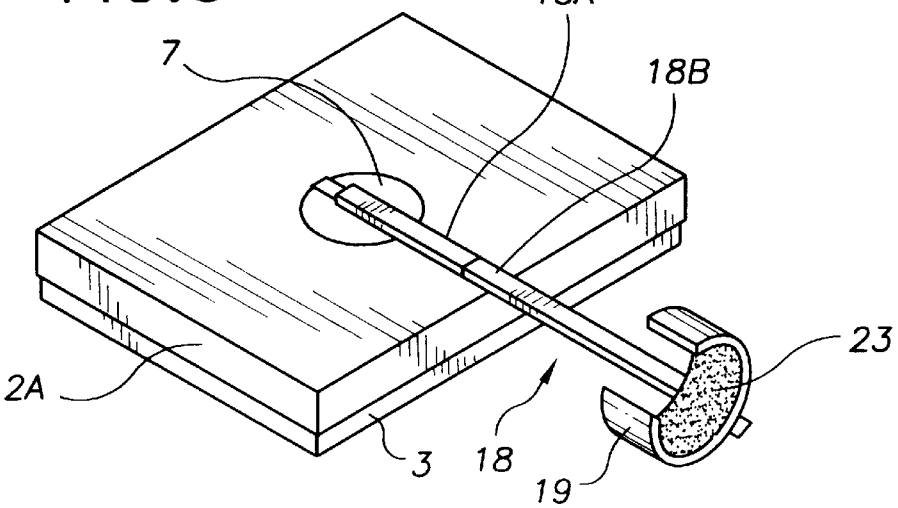
FIG. 3 depicts an alternative embodiment of the device wherein an arm component is attached to the bottom surface of the clipboard.
Figure 1:
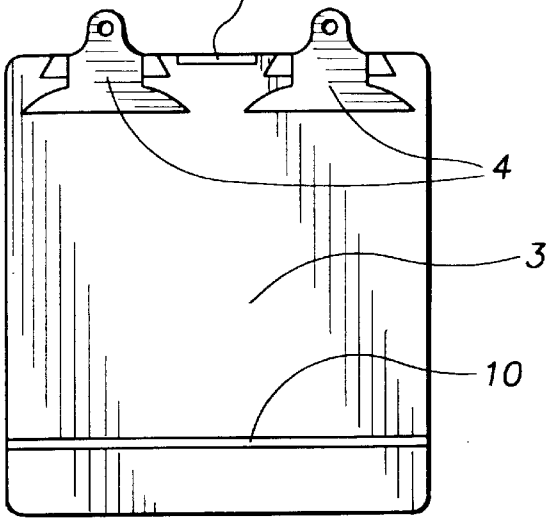
FIG. 1 depicts a top view of the inventive device including the lid component, the paper clips and paper holding strap attached thereto.
Figure 5:
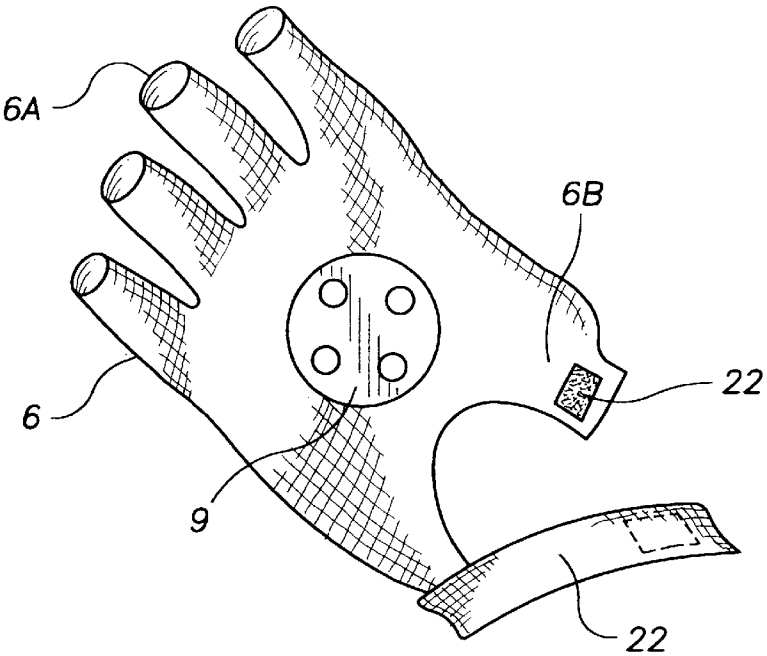
FIG. 5 depicts the glove component according to the present invention.
Figure 4:
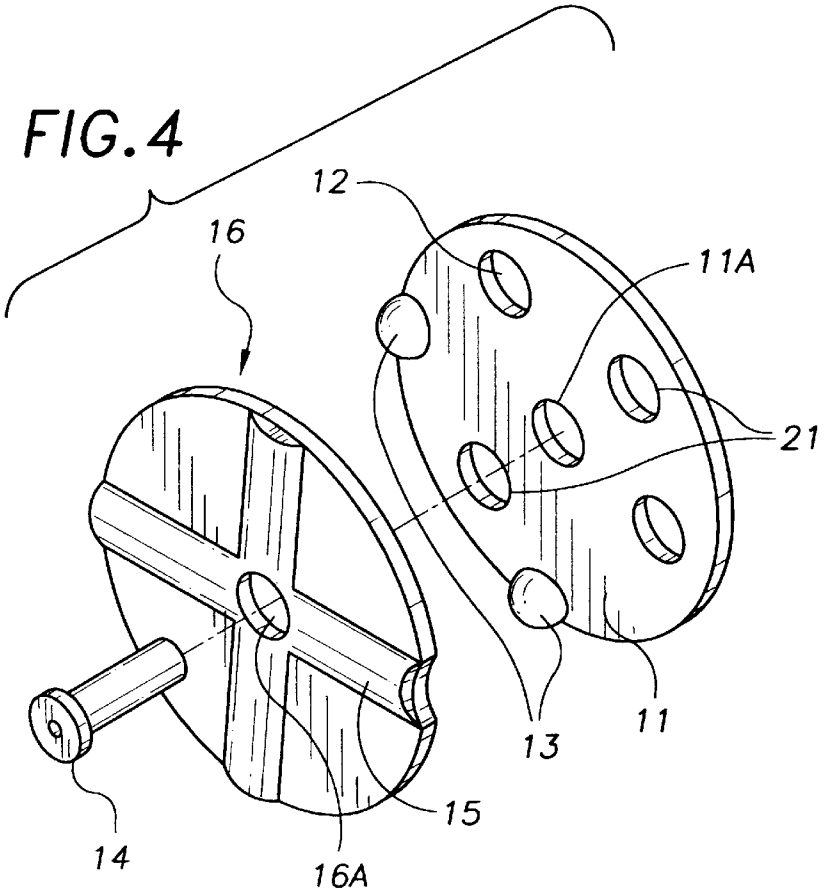
FIG. 4 depicts the attachment disc and bearing assembly.

Referring now to FIGS. 1 through 5, the invention generally relates to a clipboard/portfolio assembly that may be attached to a person's hand, wrist or forearm and may be selectively rotated to a desired position. The device comprises a substantially rectangular base component 2 having a flat bottom surface and four sides vertically depending from said bottom surface. The area between the four sides and the bottom surface define a substantially rectangular paper holding bin 2A.

A substantially rectangular lid component 3 having two planar sides is attached to a side of the base component 2 using a hinge means 8. The lid component 3 has approximately the same dimensions as the bottom surface of the base component. The hingedly engaging lid component 3 allows the paper holding bin to be selectively enclosed forming a top surface opposite the bottom surface. The top surface may be used as a writing or paper holding surface. Attached to a side of the base component 2 proximal the hinge 8 are one or more spring loaded paperclips 4 for securing a piece of paper or similar item to the exterior of the lid component 3. The paper clips 4 are generally known in the prior art and comprise a substantially flat piece of suitable material engaging the lid component 3. The clips 4 each have curved portions extending outwardly from and in substantially the same plane as the lid component 3. The spring mechanism allows the clips to tightly engage the exterior surface of the lid component so that papers may be securely held therebetween.

The device also comprises a flexible band 10 having a predetermined length comprising first and second ends with a first end attached to a side of the base component 2 and the second end attached to an opposite, parallel side. Ordinarily, the portion of the band 10 between the first and second ends will tightly engage the exterior surface of the lid component 3; its elasticity will allow it to be selectively removable therefrom. Preferably, the band 10 is attached to the two sides of the base component 2 that are perpendicular to the side having the clips 4 and proximal the side opposite the paper clips 4 so that an end of a sheet of paper can be engaged by the clips 4 and a distal end can be disposed between the band 10 and the lid component 3. This feature allows papers to be securely attached to the lid component 3 while the device is being rotated.

In one embodiment, a glove component 6 is rotatably attached to the bottom surface of the base component 2. The glove component 6 is preferably manufactured with PVC or Polyethylene providing a combination of rigidity and comfort. However, as will be readily apparent to those skilled in the art, the glove component 6 may be manufactured using any suitable fabric, material or cloth.

The glove component 6 comprises four open ended finger portions 6A extending therefrom for receiving a user's fingers and a wrist portion 6B at a distal end. The wrist portion 6B includes a fastener means 22 such as a Velcro® strap of the type generally known in the prior art for securing the glove component 6 to a user's wrist. Preferably, both sides of the glove component 6 have generic openings between the wrist and finger portions so that a user may insert his or her thumb therethrough. The generic openings are provided on both sides of the glove components 6 so that a left or right hand may be inserted therein.

The glove component 6 is rotatably attached to the bottom surface of the base component 2 using a rotating bearing assembly 7. The bearing assembly 7 comprises a substantially circular channel disc 16 having two planar sides. On a side of the channel disc 16 are a pair of mutually intersecting channels 15, each one substantially perpendicular to and substantially bisecting the other. The channels 15 are designed to receive bearings 13 as will be described in more detail below. The channel disc 16 has a centrally located aperture 16A for receiving an attachment rivet 14.

The rotating bearing assembly 7 also comprises a substantially circular bearing disc 11 having a plurality of apertures 12 each for receiving a bearing 13 therein. Preferably four bearings 13 are received within four apertures 12 and the bearings and apertures are circumferentially arranged in 90 degree intervals so that all four bearings 13 are received within the channels 15 after each ninety degree rotation of the bearing disc. The bearing disc 11 has one or more mounting apertures 21 for attaching the disc to the glove component 6. The bearing disc 11 also has a centrally located aperture 11A for aligning with the aperture 16A on the channel disc 16 and for receiving the attachment rivet 14.

An attachment disc 9 is attached to the exterior of the glove component 6 and has a plurality of mounting holes thereon for attaching the bearing assembly thereto. The bearing assembly 7 may be secured to the attachment disc using any suitable attachment means. The attachment rivet 14 is then used to attach the glove component 6 and bearing assembly 7 to the bottom surface of the base component 2.

The bearing assembly described above allows the glove component 6 to selectively rotate relative to the base component as well as index and lock for every ninety degrees of rotation. Each of the four bearings 13 will be tightly received within the apertures 12 and the channels 15. Upon rotation of the glove component 6, the bearings 13 will be removed from the channels but will be tightly engaged between the channel disc 16 and the attachment disc 9 allowing the bearings to remain within the apertures 12. When the glove component 6 is rotated ninety degrees, each of the bearings will reseat within the channels 15 locking the glove component 6 in place. In this fashion, the glove component 6 may be selectively rotated to a desired position and will be indexed every ninety degrees.

In alternative embodiment, an arm component 18 is attached to the bearing assembly 7 instead of the glove component 6. This embodiment is more suitable for warehouse or dock workers. The arm component 18 comprises a first elongated member 18A having first and second ends with the first end attached to the bearing assembly 7. A second elongated member 18B is pivotally attached to the second end of the first elongated member 18A. A substantially C shaped arm attachment member 19 is attached to a distal end of the second elongated member 18B. The arm attachment member 19 is designed to receive the wrist or forearm of a user. Preferably, the C shaped arm component has an attachment means 23 such as a Velcro® strap 23 to secure the device to a person's arm.

Using the rotating bearing assembly in conjunction with the pivoting arm component will allow the user to attach the device to his or her arm and adjust the clipboard to a desired location. The above description is provided as an example and illustration of the preferred embodiment and the present invention is not intended to be limited to the exact features and details of construction described above. For example, in addition to the portfolio assembly described above, the same concept may also be applied to single piece clipboard, a notebook or other similar binders that are used for organizing or retaining forms, papers, invoices, etc. From the above description, it is now apparent that the present invention provides a new clipboard that can be easily attached to a user's hand, wrist or forearm and can rotate thereabout. As will be readily apparent to those skilled in the art, the above described assembly may be manufactured using various materials and the shape and size of the various components including the base component may be varied to suit a particular application. It is understood that although there has been shown and described the preferred embodiment of the described invention, that modifications may be made to the invention which do not exceed the scope of the appended claims. Accordingly the scope of my invention is to be limited only by the following claims.

I claim:

1. A rotatable clipboard comprising:

a base component having a planar bottom surface, four sides depending from said bottom surface, the area between said bottom surface and said sides defining a paper holding bin;

a lid component having an exterior surface, said lid component hingedly engaging a side of said base component to selectively enclose said paper holding bin;

a rotating, indexing bearing means mounted to the bottom surface of said base component;

a glove component mounted to said bearing means allowing said glove to rotate relative to said base component and lock for every predetermined degree of rotation thereof.

2. A device according to claim 1 wherein said rotating, indexing bearing means comprises:

a substantially circular channel disc mounted to the bottom surface of said base component; said disc having a pair of mutually intersecting, bisecting channels substantially perpendicular to each other;

a substantially circular bearing disc having a plurality of apertures thereon, said bearing disc attached to said channel disc;

a bearing received within each aperture that selectively engages one of said channels for each predetermined angle that said bearing disc is rotated;

a substantially circular attachment disc having two planar sides, one side of which is attached to an exterior portion of said glove component while the second side is attached to said bearing disc.

3. A rotatable clipboard according to claim 1 wherein said glove component further comprises:

a wrist portion;

a body portion adjacent said wrist portion for receiving a human hand;

a plurality of open ended finger portions extending from said body portion;

a pair of oppositely facing slots on said body portion for selectively receiving a thumb of a person's hand.

4. A rotatable clipboard according to claim 3 wherein said glove component further comprises a fastener means proximal said wrist portion allowing the glove component to be securely attached to a person's hand.

5. A rotatable clipboard according to claim 1 further comprising means for selectively attaching papers to the exterior surface of said lid component.

6. A rotatable clipboard according to claim 5 wherein said means for selectively attaching papers to the exterior surface of said lid component comprises:

a substantially planar, spring loaded clip attached to a side of said base component having a substantially flat portion tightly engaging the exterior surface of said lid component and a curved portion extending from said flat portion allowing a user to selectively pivot said flat portion away from the exterior surface of said lid component.

7. A rotatable clipboard according to claim 5 wherein said means for selectively attaching papers to the exterior surface of said lid component comprises:

a strip of flexible material having first and second ends, the first end attached to a side of said base component, said second end attached to an opposite side of said base component, said strip tightly engaging the exterior surface of the lid component and selectively removable therefrom.

8. A rotatable clipboard comprising:

a base component having a planar bottom surface and four sides depending therefrom, the area between said bottom surface and said four sides defining a paper holding bin;

a lid component, having an exterior surface, said lid component hingedly engaging a side of said base component to selectively enclose said paper holding bin;

an indexing rotating bearing means mounted to the bottom surface of said base component;

an elongated arm component having two opposing ends with a first end mounted to said bearing means allowing said arm to rotate relative to said base component and lock for every predetermined degree of rotation thereof.

9. A device according to claim 8 wherein said indexing rotating bearing assembly comprises:

a substantially circular channel disc mounted to the bottom surface of said base component, said disc having a pair of mutually intersecting, bisecting channels substantially perpendicular to each other;

a substantially circular bearing disc having a plurality of apertures thereon, said bearing disc attached to said channel disc;

a bearing received within each aperture that selectively engages one of said channels for each predetermined angle of rotation of said bearing disc;

a substantially circular attachment disc having two planar sides, one side of which is attached to an exterior portion of said first end of said elongated arm and a second side is attached to said bearing disc.

10. A rotatable clipboard according to claim 8 wherein said elongated arm component further comprises:

a pair of pivotally joined elongated members allowing said arm component to fold onto itself.

11. A rotatable clipboard according to claim 8 further comprising a substantially C-shaped attachment member attached to a second end of said arm component to secure said arm to a user's limb.

12. A rotatable clipboard according to claim 11 wherein said arm component further comprises a fastener means attached to the C-shaped attachment member for further securing the device to a person's limb.

13. A rotatable clipboard according to claim 8 further comprising means for selectively attaching papers to the exterior surface of said lid component.

14. A rotatable clipboard according to claim 13 wherein said means for selectively attaching papers to the exterior surface of said lid component comprises:

a substantially planar, spring loaded clip attached to a side of said base component having a substantially flat portion tightly engaging the exterior surface of said lid component and a curved portion extending from said flat portion allowing a user to selectively pivot said flat portion away from the exterior surface of said lid component.

15. A rotatable clipboard according to claim 13 further comprising a strip of flexible material having a first end and a second end, the first end attached to a side of said base component said, second end attached to an opposite side of said base component, said strip tightly engaging the exterior surface of the lid component and selectively removable therefrom.

* * * * *